United States Patent [19]

Gimple

[11] Patent Number: 4,989,793

[45] Date of Patent: Feb. 5, 1991

[54] INDIRECT CHARGING ELECTRODE FOR ELECTROSTATIC SPRAY GUNS

[75] Inventor: James J. Gimple, Oregon, Ohio

[73] Assignee: Illinois Tool Works, Inc., Glenview, Ill.

[21] Appl. No.: 473,356

[22] Filed: Feb. 2, 1990

[51] Int. Cl.[5] ..... B05B 5/025

[52] U.S. Cl. ..... 239/696; 239/707; 239/105

[58] Field of Search ..... 239/104, 105, 113, 290, 239/299, 690, 696, 704–707

[56] References Cited

U.S. PATENT DOCUMENTS

| | | | |
|---|---|---|---|
| 3,393,662 | 7/1968 | Blackwell | 118/626 |
| 3,625,424 | 12/1971 | Mantica | 239/3 |
| 3,635,401 | 1/1972 | Bromley et al. | 239/15 |
| 3,767,115 | 10/1973 | Kozinski et al. | 239/15 |
| 3,837,573 | 9/1974 | Wagner | 239/15 |
| 3,940,061 | 2/1976 | Gimple et al. | 239/15 |
| 3,952,951 | 4/1976 | Raetz et al. | 239/15 |
| 4,143,819 | 3/1979 | Hastings | 239/707 |
| 4,157,162 | 6/1979 | Benedek et al. | 239/707 |
| 4,194,696 | 3/1980 | Harjar | 239/707 |
| 4,240,585 | 12/1980 | Sickles | 239/705 |
| 4,245,784 | 1/1981 | Garcin | 239/3 |
| 4,798,341 | 1/1989 | Gimple | 239/290 |
| 4,852,810 | 8/1989 | Behr et al. | 239/703 |

FOREIGN PATENT DOCUMENTS

| | | | |
|---|---|---|---|
| 178746 | 4/1986 | European Pat. Off. . | |
| 8810152 | 12/1988 | World Int. Prop. O. | 239/706 |

*Primary Examiner*—Andres Kashnikow
*Assistant Examiner*—Karen B. Merritt
*Attorney, Agent, or Firm*—MacMillan, Sobanski & Todd

[57] ABSTRACT

Improved apparatus for indirectly charging atomized electrically conductive fluids discharged from a spray gun. One or more high voltage electrodes are located outside of the atomized fluid envelope for imparting a charge to the fluid droplets. Air curtains are established to surround insulated electrode holders for preventing a buildup of electrically conductive deposits on the holders. The air curtain is strongest at the end of the holder closest to the atomized paint envelope. The electrodes may be supported from an adapter which permits retrofitting on existing direct charge electrostatic spray guns.

6 Claims, 2 Drawing Sheets

INDIRECT CHARGING ELECTRODE FOR ELECTROSTATIC SPRAY GUNS

TECHNICAL FIELD

The invention relates to electrostatic spraying and more particularly to an improved indirect charging electrode for an electrostatic spray gun permitting application of electrically conductive fluids such as water bourne paints.

BACKGROUND ART

For environmental reasons, it is becoming more popular to replace solvent based paints with water bourne paints in many industrial applications. To achieve high coating transfer efficiencies, coatings are often applied with an electrostatic process. As the liquid coating material is atomized, a high electrostatic charge is imparted to the coating droplets relative to a grounded workpiece. The charge on the droplets may be as high as 100,000 volts, or more. The resulting electrostatic field attracts the charged droplets to the workpiece. Even misdirected droplets which would otherwise miss the workpiece are deposited on the workpiece.

Problems occur with electrostatic application of electrically conductive coating materials, such an water bourne paints. When the material supply source is electrically grounded and the material has sufficient conductivity, the material cannot be properly charged with a high voltage electrode exposed to the paint column at the spray gun nozzle. Various techniques have been used for charging electrically conductive paints. One method involves isolating from ground the paint source, the paint supply hoses and the spray gun. As a consequence, all portions of the system exposed to the paint are maintained at the high voltage. Steps must be taken to protect the system operator from exposure to the high voltage. In another type of system, the paint source, the paint hoses and the spray gun are all maintained at ground potential. An electrode is mounted on the spray gun to extend to just outside of the atomized paint envelope adjacent the spray gun nozzle. The electrode is mounted in an insulated holder and has only an exposed high voltage tip.

Although indirect charging apparatus works effectively for charging water bourne paints, its efficiency decreases if paint becomes deposited on the insulated electrode holder. If sufficient paint is deposited on the electrode holder, it may become electrically conductive and grounds the high voltage electrode. U.S. Pat. No. 3,952,951 has reduced this problem by directing jets of air towards the electrode holder. Paint deposits are eliminated where the air jets impinge on the electrode holder. However, the arrangement shown in this patent does not protect all sides of the electrode holder from deposits. Nor does it afford maximum protection at the tip of the holder adjacent the electrode, where risk of paint deposits is greatest because of its close proximity to the atomized paint envelope.

DISCLOSURE OF INVENTION

According to the invention, an improved spray gun is provided for indirectly charging atomized coating fluids such as water bourne paints. The spray gun includes a conventional nozzle for discharging and atomizing the liquid paint into droplets. As the paint is discharged from the spray gun, it is indirectly charged by one or more high voltage electrodes mounted just outside of the atomized paint envelope. The electrodes extend from electrically insulated tubular holders. To prevent paint buildup, an air shield is provided for the exterior surfaces of the electrode holders. The air shield is created by delivering air through an axial opening in the holder to a free end of the holder adjacent the exposed electrode. The air is discharged through an annular orifice surrounding the holder and is directed back along the surfaces of the holder. Thus, the risk of the electrode being grounded through conductive deposits on the insulated electrode holder is significantly reduced. Further, the air shield is most effective adjacent the electrode holder tip where the risk of paint deposits is greatest.

Accordingly, it is an object of the invention to provide improved apparatus for indirectly charging an atomized fluid discharged from a spray gun.

Other objects and advantages of the invention will be apparent from the following detailed description and the accompanying drawings.

BEST MODE FOR CARRYING OUT THE INVENTION

Figure 1:
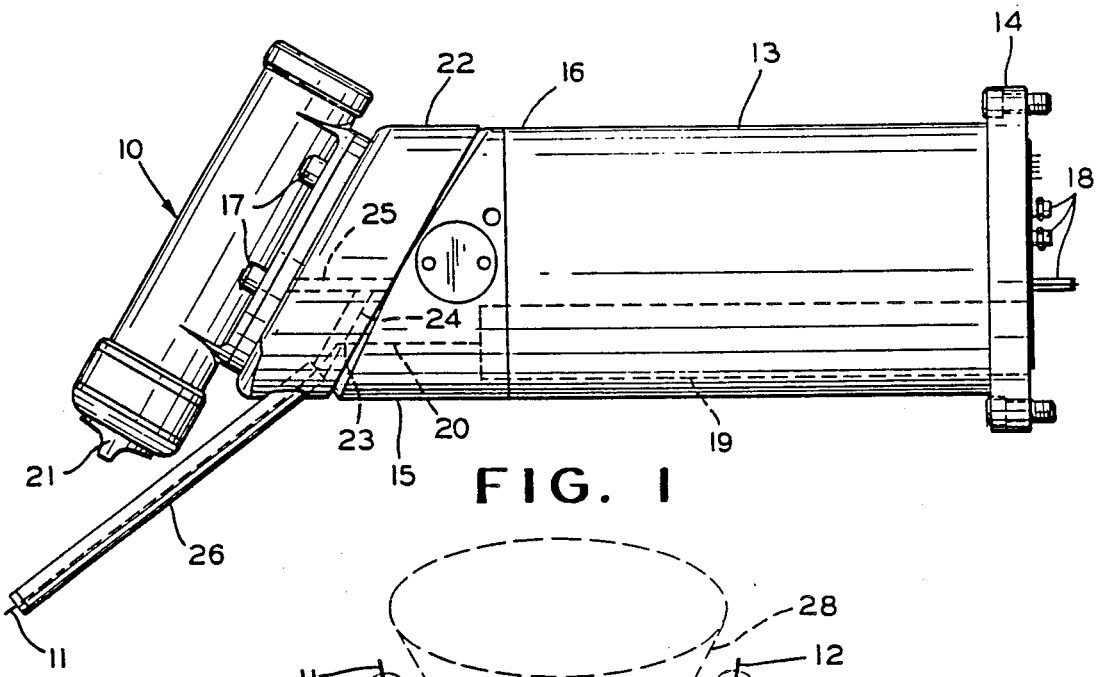
FIG. 1 is a side elevational view of an exemplary electrostatic paint spray gun incorporating two improved indirect charging electrodes according to the invention.
Figure 2:
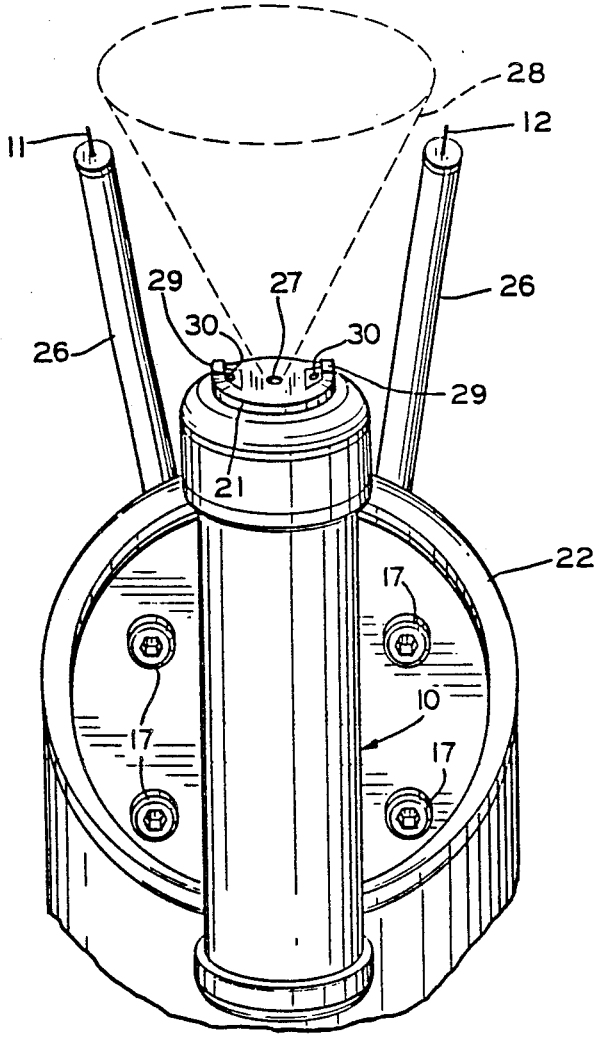
FIG. 2 is a top view of the spray gun and electrodes of FIG. 1, with the spray gun support housing shown in fragmentary.

Referring to FIGS. 1 and 2 of the drawings, an exemplary electrostatic spray gun 10 is illustrated incorporating two indirect paint charging electrodes 11 and 12 according to the invention. The electrodes 11 and 12 permit the spray gun 10 to be used to apply materials which are sufficiently conductive as to prevent their use with direct charging electrodes when the paint source is grounded. The illustrated spray gun 10 is designed for mounting on a robot (not shown) and is shown in greater detail in U.S. Pat. No. 4,798,341. It will be appreciated that one or more of the indirect charging electrodes 11 and 12 of the invention may be used with other known spray gun designs.

A spray gun support housing 13 is provided with an end 14 adapted to be attached to the end of a robot arm (not shown). A manifold 15 is attached to an opposite end 16 of the housing 13. For applying electrically non conductive materials such as solvent based paints, the spray gun 10 may be attached directly to the manifold 15 by a plurality of bolts 17. The manifold has passages and may have valves for controlling the delivery of coating material, compressed air for atomization and pattern shaping and control air from external sources (not shown) to the spray gun 10. The external air and liquid sources are connected to a plurality of connectors or fittings 18 on the housing end 14. A high voltage power supply 19 may be located in the housing 13. The power supply 19 is operated from a low voltage supplied through one of the housing connectors 18. The high voltage normally is applied through a conductor 20 in the manifold to the spray gun 10 where it is normally connected to an electrode (not shown) in contact with the paint discharged from a nozzle assembly 21 on the spray gun 10.

According to the invention, an adapter 22 is positioned between the spray gun 10 and the manifold 15. The indirect charging electrodes 11 and 12 are supported from the adapter 22. The adapter 22 is provided with internal passages (not shown) for maintaining communication between liquid and compressed air passages in the manifold 15 and the spray gun 10. However, the adapter 22 includes a conductor 23 which connects the high voltage on the conductor 20 to the electrodes 11 and 12 and blocks the application of high voltage to the spray gun 10. The adapter 22 also includes a passage 24 which connects one of the compressed air passages 25 extending through the adapter 22 between the manifold 15 and the spray gun 10 with an electrode support tube or holder 26.

As best seen in FIG. 2, the nozzle assembly 21 discharges the coating liquid from an orifice 27, whereupon the liquid is atomized into droplets. The droplets are directed forwardly and outwardly through a generally conical envelope represented by the dashed lines 28. The nozzle assembly 21 typically includes two air horns 29 arranged on diametrically opposite sides of the orifice 27. Compressed air is discharged from an orifice 30 on each air horn 29 towards opposite sides of the atomized liquid envelope 28 for flattening and shaping the envelope 28. Depending on the flow of pattern shaping air to the air horn orifices 30, the cross section of the envelope 28 may vary from round when no pattern shaping air is present to generally flat when a maximum flow of pattern shaping air is present.

The electrode support tubes are mounted on the adapter 22 to extend outside of the envelope 28 and to position the electrodes 11 and 12 outside of and close to the envelope 28. The paint droplets in the envelope 28 are electrostatically charged by the electrostatic field surrounding the exposed electrodes 11 and 12. Since the droplets are dispersed in air, there is no direct path to ground, even though the droplets may be formed from an electrically conductive material and the spray gun 10 and the paint source may be electrically connected to ground. However, it should be appreciated that some of the droplets will escape outside of the envelope 28. Over a period of time, some of these escaped droplets will tend to deposit on the electrode support tubes 26, unless the tubes 26 are protected by an air curtain. If the droplets are electrically conductive and are deposited on the tubes 26, eventually the electrodes 11 and 12 may become electrically shorted through the deposits to ground. As a consequence, it is necessary either to periodically shut down the spray gun 10 and to clean the support tubes 26 or to provide a means such as an air curtain for protecting the tubes from paint accumulation.

Figure 3:
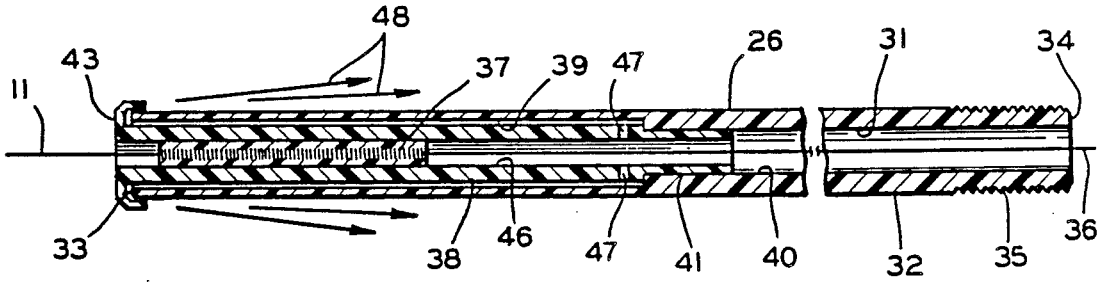
FIG. 3 is a fragmentary cross sectional view through an indirect paint charging electrode according to the invention.
Figure 4:
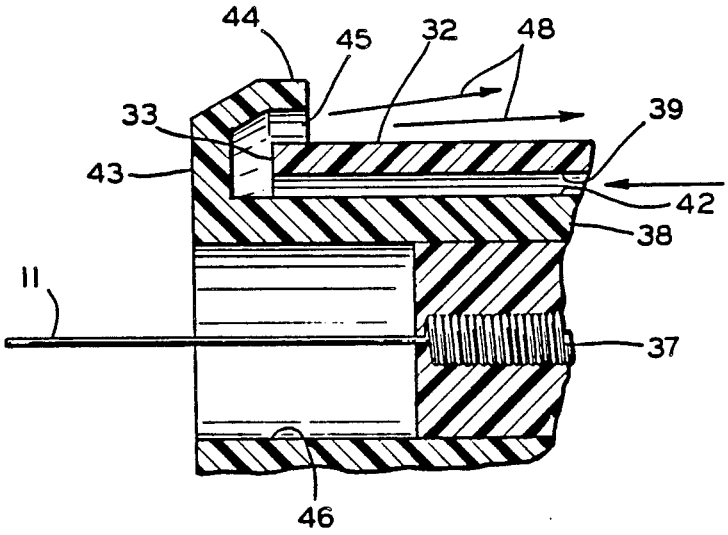
FIG. 4 is an enlarged fragmentary cross sectional view through the free end of the electrode of FIG. 3.

Details of the electrode 11 and the support tube 26 are shown in FIGS. 3 and 4. Of course, it will be appreciated that the electrode 12 will be of the same construction. The electrode support tube 26 is an elongated hollow tube having a central opening 31, an exterior surface 32 and first and second ends 33 and 34, respectively. The exterior surface 32 at the second end 34 may form threads 35 for threadably engaging a corresponding threaded opening (not shown) in the adapter 22 for securing the tube 26 to the adapter 22. A wire 36 extends from outside the tube end 34 through the central opening 31 and is connected to one end of a high value resistor 37. When the tube 26 is secured to the adapter 22, the wire 36 at the tube end 34 contacts and receives high voltage from the conductor 23 in the adapter 22. The electrode 11 is attached to the other end of the resistor 37 and projects coaxially from the central opening 31 at the first end of the tube 26. Preferably, the resistor 37 blocks the central opening 31 at an intermediate location between the tube ends 33 and 34. The wire 36, the resistor 37 and the electrode 11 form a continuous conductor extending from the tube end 34 to the tube end 33.

A tubular insert 38 extends into the central tube opening 31 at the end 33. Preferably, the central opening 31 is stepped and has a larger diameter portion 39 adjacent the first tube end 33 and a smaller diameter portion 40 adjacent the second end 34. The insert 38 extends through the larger diameter portion 39 and has a reduced diameter end 41 which is pressed into or otherwise secured to the smaller diameter portion 40 to maintain the insert coaxial in the central opening 31.

The portion of the insert 38 within the larger diameter portion 39 of the central opening 31 has a smaller diameter than the diameter of the central opening portion 39. Consequently, an annular passage 42 is defined between the tube 26 and the insert 38. The insert 38 has a section 43 which is spaced forward of and wraps around the tube end 33. The section 43 terminates at an end 44 which is spaced from the exterior tube surface 32 to form an annular orifice 45. The orifice 45 extends around the tube 26 and is directed back along the tube surface 32. Finally, the insert 38 has a central opening 46 and one or more passages 47 extending through the insert 38 adjacent the end 41. The passages 47 connect the central opening 46 with the annular passage 39, which in turn leads to the annular orifice 45. The central insert opening 46 is aligned with the central tube opening 31 to form a continuous passage through the tube 26. Preferably, the resistor 37 is secured in and closes the insert opening 46 for blocking the central opening 31.

As previously indicated, compressed air is applied through the adapter 22 to the central tube opening 31 at the tube end 34. This air flows through the tube portion 40, the insert opening 46, the passages 47, and the annular passage 39 to the annular orifice 45. A flow of such air is discharged from the orifice 45 and flows back along the tube surface 32, as represented by the arrows 48. The air flow forms an effective air curtain which surrounds the tube surface 32 and prevents the accumulation of atomized coating on the surface 32. As a consequence, the down time required for cleaning the spraying apparatus is reduced and the risk of the high voltage being grounded through deposits on the electrode support tube 26 is reduced. The air curtain is particularly effective for preventing deposits on the surface 32 since the air curtain is strongest where the surface 32 is closest to the atomized paint envelope 28. Further, the air curtain completely surrounds the tube 26. Finally, the air curtain is directed away from and does not disturb the atomized paint envelope 28.

The electrodes 11 and 12 have been described as being secured to an adapter which may be retroactively inserted between an existing spray gun and its support. Thus, an existing direct charge spray gun may be readily adapted to apply coating materials which are sufficiently conductive as to require either indirect charging or isolating the material source from ground. It should be understood that electrodes according to the invention also may be permanently secured to a spray gun during manufacture and are adaptable to other spray gun designs. Other modifications and changes to the electrodes will be apparent to those skilled in the art without departing from the spirit and the scope of the following claims.

I claim:

1. An improved electrode for indirectly charging atomized liquid droplets discharged from a spray nozzle to a high voltage, said electrode receiving the high voltage from a power source, said electrode comprising an elongated tubular housing having a central opening extending between first and second housing ends, a conductor extending through said opening and having an electrode end projecting from said first housing end, means for supplying compressed air to said second housing end, and means at said first housing end for directing a flow of such compressed air back along exterior surfaces of said housing toward said second housing end to prevent liquid droplets from accumulating on said housing surfaces.

2. An improved electrode, as set forth in claim 1, wherein said directing means includes means at said first housing end for forming an annular orifice, said orifice having a diameter greater than the diameter of said housing, and said orifice opening towards said second housing end for discharging such compressed air towards said second housing end.

3. An improved electrode, as set forth in claim 2, wherein said housing includes an annular passage connecting with said annular orifice, means for blocking said central housing opening at a location spaced between said first and second housing ends, and at least one passage means connecting said annular passage with said central housing opening between said blocking means and said second end for delivering such compressed air from said central housing opening to said annular passage.

4. An improved electrode, as set forth in claim 3, wherein said conductor includes a resistor, and wherein said blocking means also includes said resistor.

5. An improved electrode, as set forth in claim 2, and further including a tubular insert extending into said first end of said central housing opening, said insert having a central opening aligned with said central housing opening, said conductor extending through said central insert opening, said insert having a wall portion spaced inwardly from a wall of said central housing opening to form an annular passage, said insert having an end spaced from and wrapped around said first housing end for connecting said annular passage with said annular orifice, and means for delivering compressed air from said central housing opening to said annular passage.

6. For an electrostatic spray gun mounted on a manifold, said manifold supplying compressed air, coating liquid and high voltage to said spray gun, apparatus for indirectly charging atomized liquid discharged from said spray gun comprising an adapter for positioning between said spray gun and said manifold, said adapter having passages for maintaining compressed air and coating liquid communication between said manifold and said spray gun, at least one electrode means for indirectly charging atomized liquid discharged from said spray gun, an electrode support housing having a first end from which said electrode extends and a second end secured to said adapter, said adapter and said housing including means for applying the high voltage from said manifold to said electrode, said adapter having a passage for diverting a flow of compressed air from said manifold to said housing, and means at said first housing end for directing such diverted compressed air back along exterior surfaces of said housing toward said second housing end to prevent atomized liquid from accumulating on said housing surfaces.

* * * * *